US007289012B2

(12) United States Patent
Tran-Ngoc et al.

(10) Patent No.: US 7,289,012 B2
(45) Date of Patent: Oct. 30, 2007

(54) ELECTROMAGNETIC COIL ASSEMBLY

(75) Inventors: Truc Tran-Ngoc, Mississauga (CA); Christopher Bennett, Cambridge (CA)

(73) Assignee: Polymer Technologies Inc., Cambridge, ON (CA)

( * ) Notice: Subject to any disclaimer, the term of this patent is extended or adjusted under 35 U.S.C. 154(b) by 0 days.

(21) Appl. No.: 11/101,587

(22) Filed: Apr. 8, 2005

(65) Prior Publication Data

US 2005/0225418 A1 Oct. 13, 2005

Related U.S. Application Data

(60) Provisional application No. 60/560,028, filed on Apr. 8, 2004.

(51) Int. Cl.
*H01F 27/00* (2006.01)

(52) U.S. Cl. ..... 336/90

(58) Field of Classification Search ..... 336/65, 336/90, 92, 94, 192, 198, 208, 209; 335/251, 335/255; 251/129.15
See application file for complete search history.

(56) References Cited

U.S. PATENT DOCUMENTS

| | | | | |
|---|---|---|---|---|
| 3,939,450 | A | | 2/1976 | Donnelly |
| 3,946,350 | A | | 3/1976 | Goto |
| 4,160,967 | A | | 7/1979 | Beech |
| 4,222,023 | A | | 9/1980 | Beech |
| 4,291,292 | A | | 9/1981 | Witchger |
| 4,376,904 | A | | 3/1983 | Horrigan |
| 4,400,226 | A | | 8/1983 | Horrigan |
| 4,510,478 | A | | 4/1985 | Finkbeiner |
| 4,734,976 | A | | 4/1988 | Matson |
| 4,846,912 | A | | 7/1989 | Noel |
| 4,954,801 | A | | 9/1990 | Urbanski et al. |
| 5,028,905 | A | * | 7/1991 | Lostumo ..... 336/205 |
| 5,132,655 | A | | 7/1992 | Suzuki et al. |
| 5,153,550 | A | * | 10/1992 | Sugiura et al. ..... 336/192 |
| 5,160,116 | A | * | 11/1992 | Sugiura et al. ..... 251/129.14 |
| 5,220,304 | A | | 6/1993 | Ho |
| 5,307,038 | A | | 4/1994 | Ishimaru |
| 5,774,036 | A | | 6/1998 | Hrytzak et al. |
| 5,838,220 | A | | 11/1998 | Hagberg |
| 6,103,382 | A | | 8/2000 | Smith et al. |
| 6,292,083 | B1 | | 9/2001 | Tajima et al. |
| 6,337,615 | B1 | | 1/2002 | Dittmann et al. |
| 6,587,024 | B2 | | 7/2003 | Matsumoto |
| 6,737,949 | B2 | | 5/2004 | Nam et al. |
| 6,838,969 | B2 | | 1/2005 | Suda |
| 6,842,102 | B2 | | 1/2005 | Matsumoto |

* cited by examiner

*Primary Examiner*—Tuyen T. Nguyen
(74) *Attorney, Agent, or Firm*—Neil Henderson

(57) ABSTRACT

An electromagnetic coil assembly is provided. The electromagnetic coil assembly includes a bobbin, a coil of magnet wire and a cover piece. The bobbin includes a hub, a first flange and a second flange. The hub has a longitudinal axis. The first and second flanges are spaced axially from each other. The hub and flanges together define a circumferential bobbin channel. The bobbin is made from a material that is an electrical insulator. The coil of magnet wire is positioned around the hub in the circumferential bobbin channel. The magnet wire has first and second ends. The cover piece is self-supporting and is sized to extend circumferentially around the coil of magnet wire. The cover piece is resilient and exerts a compressive force radially inwardly on the coil of magnet wire.

7 Claims, 7 Drawing Sheets

ELECTROMAGNETIC COIL ASSEMBLY

FIELD OF THE INVENTION

This invention relates to an electromagnetic coil assembly.

BACKGROUND OF THE INVENTION

An electromagnetic coil assembly is typically made by winding a large number of turns of magnet wire around a bobbin, thereby forming a coil around the bobbin. The bobbin is typically made from non-conductive and non-magnetic material. The coil is connected to an electrical power source via electrical lead wires or terminals. With a voltage across the ends of the magnet wire, an electrical current will circulate through the coil, which in turn will generate a toroidal magnetic flux that envelopes the coil. Soft iron or other ferromagnetic material is normally used to make a yoke that envelops the coil. The yoke provides a magnetic circuit path to concentrate the magnetic flux.

Such electromagnetic coil assemblies have found many applications in components used in the manufacture of vehicles, such as, for examples electromagnetic-actuated clutches. Other, non-vehicular uses also exist, such as in object-lifting electromagnetic devices.

Some electromagnetic coil assemblies can be labour intensive and costly to manufacture. Additionally, some assemblies incorporate many components thus increasing their complexity. There is, therefore, a continuing need for improved electromagnetic coil assemblies.

SUMMARY OF THE INVENTION

In a first aspect, the present invention is directed to a housing assembly for use in an electromagnetic coil assembly with a coil of magnet wire, first and second connectors and first and second lead wire ends, wherein the magnet wire has first and second ends, wherein each connector retains and electrically connects one end of the magnet wire and one lead wire end. The housing assembly includes a bobbin, a cover piece and a connector housing. The bobbin includes a hub, a first flange and a second flange. The hub has a longitudinal axis. The first and second flanges are spaced axially from each other. The hub and flanges together define a circumferential bobbin channel for receiving the coil of magnet wire. The bobbin is made from a material that is an electrical insulator. The cover piece is self-supporting and extends circumferentially around the coil of magnet wire. The connector housing is connected to the cover piece. The connector housing has at least one connector housing channel sized to hold the first and second connectors. The at least one connector housing channel has first and second end walls which prevent withdrawal of the first and second connectors from the connector housing.

In a second aspect, the present invention is directed to an electromagnetic coil assembly. The electromagnetic coil assembly includes a bobbin, a coil of magnet wire, first and second connectors, a cover piece and a connector housing. The bobbin includes a hub, a first flange and a second flange. The hub has a longitudinal axis. The first and second flanges are spaced axially from each other. The hub and flanges together define a circumferential bobbin channel. The bobbin is made from a material that is an electrical insulator. The coil of magnet wire is positioned around the hub in the circumferential bobbin channel. The magnet wire has first and second ends. The first and second connectors each retain and electrically connect one end of the magnet wire and one end of a lead wire. The cover piece is self-supporting and extends circumferentially around the coil of magnet wire. The connector housing is connected to the cover piece. The connector housing has at least one connector housing channel. The first and second connectors are held in the at least one connector housing channel. The at least one connector housing channel has first and second end walls which prevent withdrawal of the first and second connectors from the connector housing.

In a third aspect, the present invention is directed to a housing assembly for holding a coil of magnet wire for an electromagnetic coil assembly. The housing assembly includes a bobbin and a cover piece. The bobbin includes a hub, a first flange and a second flange. The hub has a longitudinal axis. The first and second flanges are spaced axially from each other. The hub and flanges together define a circumferential bobbin channel for receiving the coil of magnet wire. The bobbin is made from a material that is an electrical insulator. The cover piece is self-supporting and is sized to extend circumferentially around the coil of magnet wire. The cover piece is resilient and is sized to exert a compressive force radially inwardly on the coil of magnet wire.

In a fourth aspect, the present invention is directed to an electromagnetic coil subassembly. The electromagnetic coil subassembly includes a bobbin, a coil of magnet wire and a cover piece. The bobbin includes a hub, a first flange and a second flange. The hub has a longitudinal axis. The first and second flanges are spaced axially from each other. The hub and flanges together define a circumferential bobbin channel. The bobbin is made from a material that is an electrical insulator. The coil of magnet wire is positioned around the hub in the circumferential bobbin channel. The cover piece is self-supporting and is sized to extend circumferentially around the coil of magnet wire. The cover piece is resilient and exerts a compressive force radially inwardly on the coil of magnet wire.

In a fifth aspect, the present invention is directed to an electromagnetic coil assembly incorporating the above described subassembly, and further including a yoke. The yoke is made from a ferromagnetic material. The yoke defines an open, circumferential yoke channel. The yoke channel is sized to receive the subassembly by axial sliding movement of the subassembly into the yoke channel In a sixth aspect, the present invention is directed to an electromagnetic coil assembly. The electromagnetic coil assembly includes a bobbin, a coil of magnet wire, first and second connectors, a cover piece, a connector housing and a yoke. The bobbin includes a hub, a first flange and a second flange. The hub has a longitudinal axis. The first and second flanges are spaced axially from each other. The hub and flanges together define a circumferential bobbin channel. The bobbin is made from a material that is an electrical insulator. The coil of magnet wire is positioned around the hub in the circumferential bobbin channel. The magnet wire has first and second ends. Each of the first and second connectors retains and electrically connects one end of the magnet wire and one end of a lead wire. The cover piece is self-supporting and extends circumferentially around the coil of magnet wire. The connector housing is connected to the cover piece, wherein the connector housing holds the first and second connectors. The bobbin, coil of magnet wire, first and second connectors, cover piece and connector housing make up a subassembly. The yoke is made from a ferromagnetic material. The yoke defines an open, circumferential yoke channel. The yoke channel is sized to receive the subassembly by axial sliding movement of the subassembly into the yoke channel. The bobbin is rotatable with respect to the cover piece and the yoke when the subassembly is positioned in the yoke channel.

BRIEF DESCRIPTION OF THE DRAWINGS

For a better understanding of the present invention and to show more clearly how it may be carried into effect, reference will now be made by way of example to the accompanying drawings, in which.

DETAILED DESCRIPTION OF THE INVENTION

Figure 1:
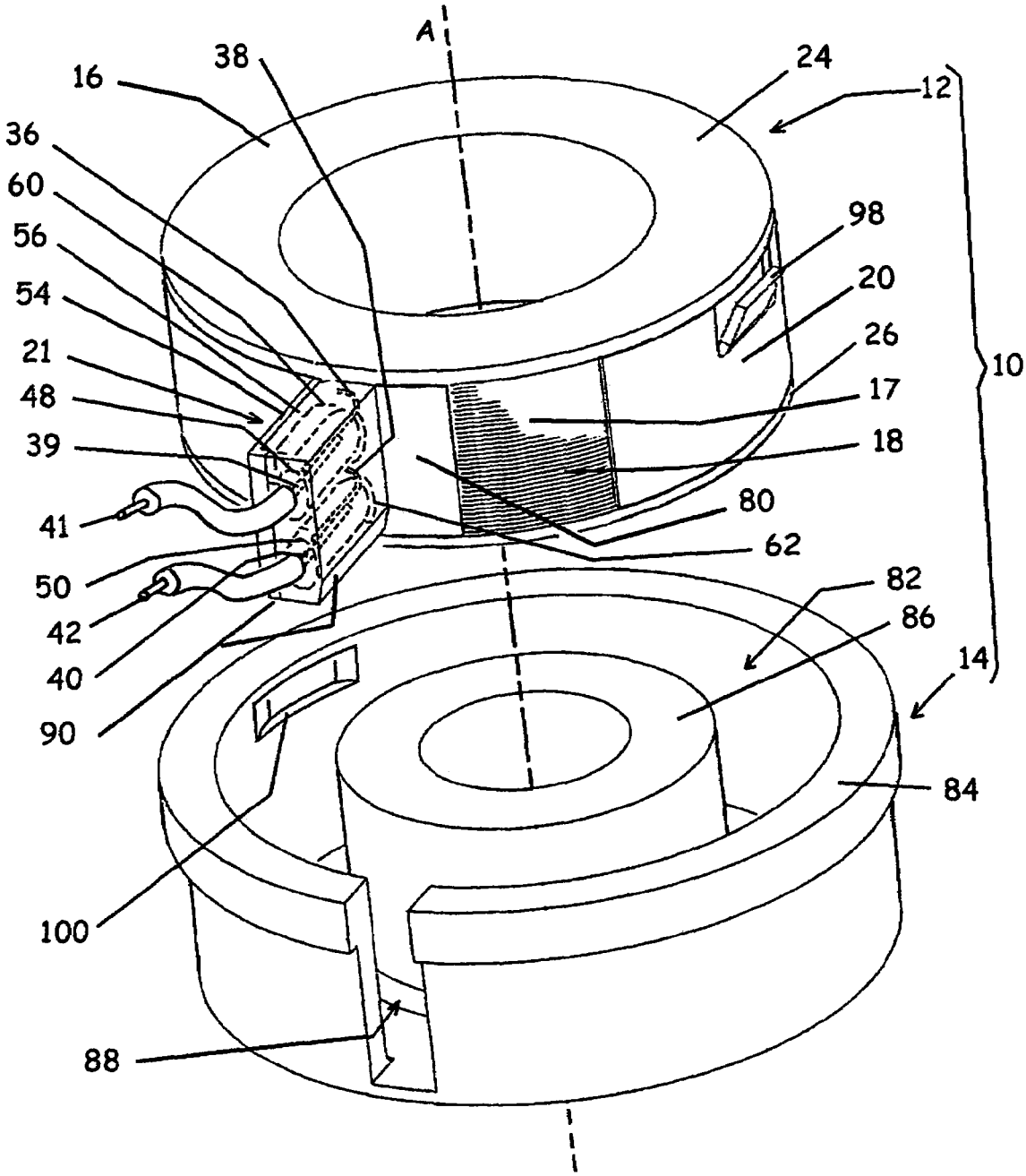
FIG. 1 is a perspective, partially exploded view of an electromagnetic coil assembly in accordance with a first embodiment of the present invention.
Figure 2:
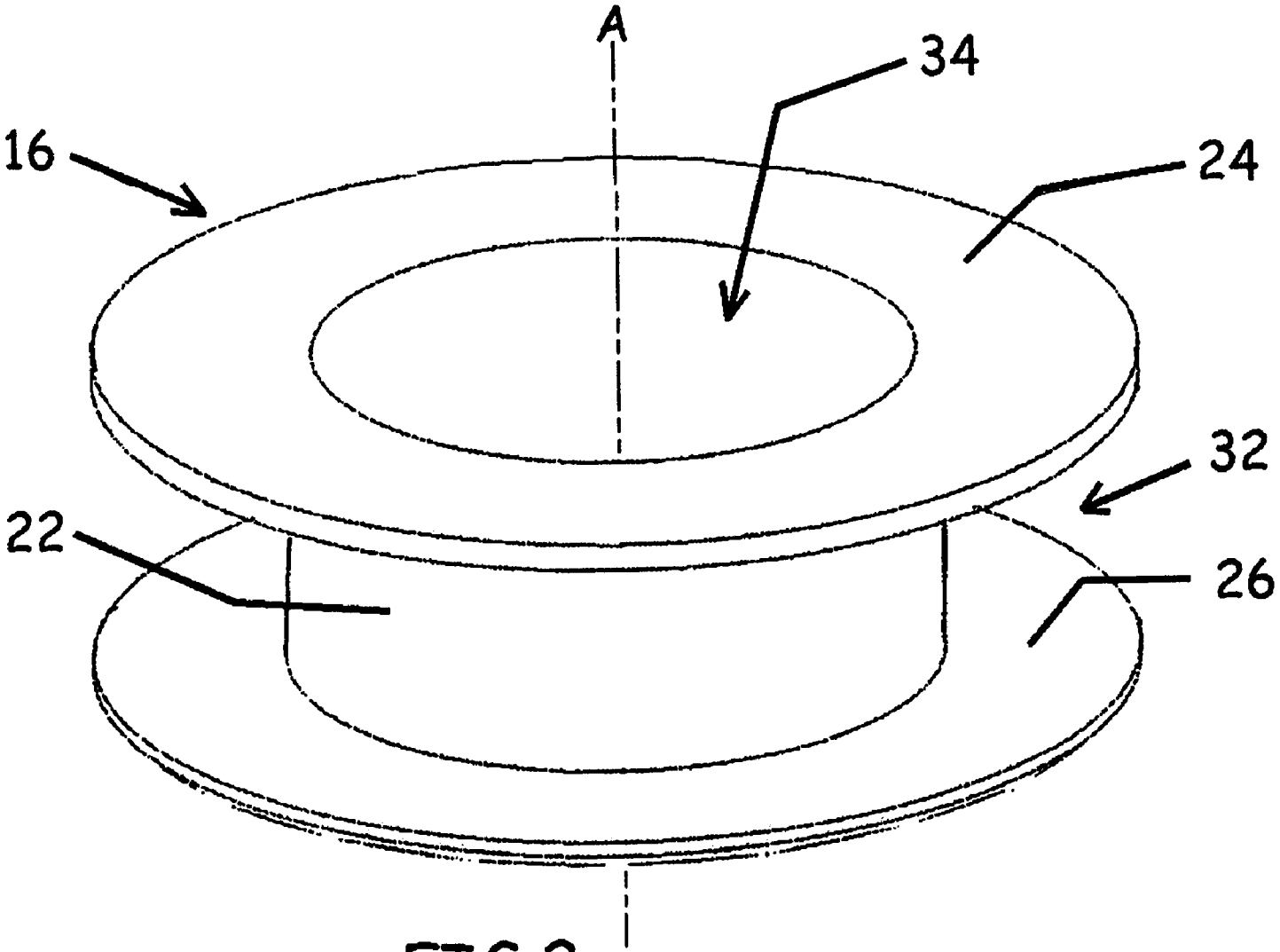
FIG. 2 is a perspective view of a bobbin shown in FIG. 1.

Reference is made to FIG. 1, which shows a partially exploded view of an electromagnetic coil assembly 10 in accordance with a first embodiment of the present invention. The electromagnetic coil assembly 10 includes a subassembly 12 and a yoke 14. The subassembly 12 includes a bobbin 16, a coil 17 of magnet wire 18, a cover piece 20 and a connector housing 21. Referring to FIG. 2, the bobbin 16 includes a hub 22, a first flange 24 and a second flange 26. The bobbin 16 has a longitudinal axis A.

The hub 22 may have any suitable shape. For example it may have a generally cylindrical shape about the axis A. The first and second flanges 24 and 26 are positioned at the axial ends of the hub 22 and are thus spaced axially from each other. The first and second flanges 24 and 26 may be circular, as shown in the figures, or alternatively, they may have some other shape, such as a square shape.

The first and second flanges 24 and 26 may be circular, as shown in the figures. Alternatively, they may be non-planar, and may have, for example, a frusto-conical shape.

The hub 22 and the first and second flanges 24 and 26 together define a circumferential channel 32 in the bobbin 16. The bobbin 16 may be hollow, and may thus have a central aperture 34.

The bobbin 16 may be made from any suitable material, such as an electrically insulative material, such as, for example, a glass reinforced nylon, polybutylene terephthalate (PBT), or some other suitable polymeric material.

Figure 2A:
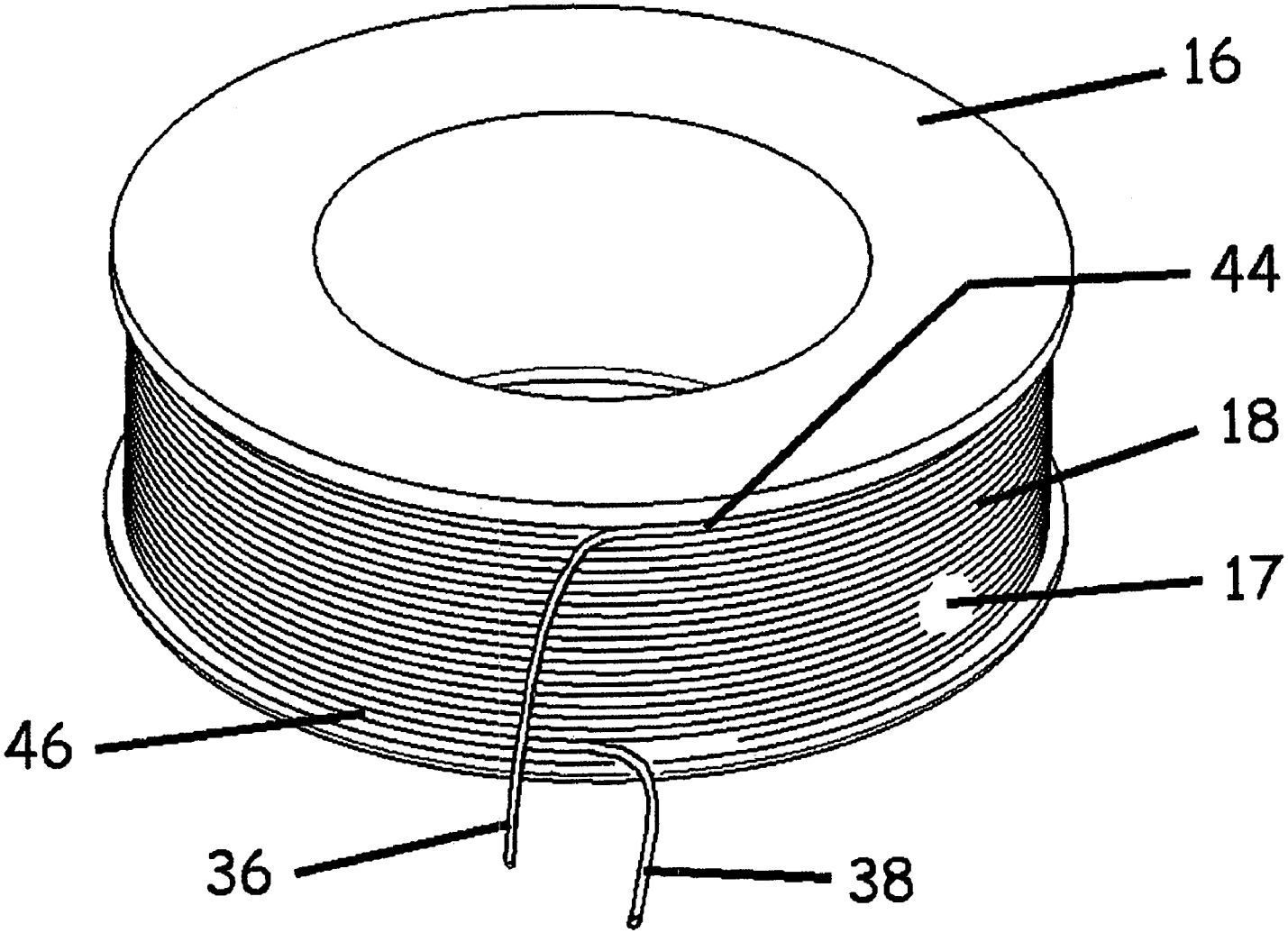
FIG. 2*a* is a perspective view of the bobbin shown in FIG. 1, with a coil of magnet wire wrapped therearound.

Referring to FIG. 2*a*, the magnet wire 18 is wrapped numerous times around the bobbin 16 in the channel 32. Preferably, the coil 17 of magnet wire 18 substantially fills the channel 32, while leaving a small amount of room for the cover piece 20 to surround the coil 17 while still fitting between the flanges 24 and 26, as shown for example in FIG. 1. The magnet wire 18 has a first end 36 and a second end 38, which are for connecting to the ends, shown at 39 and 40, of the first and second lead wires, shown at 41 and 42 (see FIG. 1). The lead wires 41 and 42 extend from an electrical power source (not shown).

Referring to FIG. 1, the cover piece 20 extends around the exterior of the coil 17 of magnet wire 18. The cover piece 20 is a self supporting piece, as opposed to a length of adhesive tape, and is sized so that it exerts a compressive force on the coil 17 of magnet wire 18, thereby holding the wire 18 in place and in contact with other wraps of the wire 18 that make up the coil 17. By maintaining contact between the wraps of magnet wire 18, thermal conduction between the wraps of magnet wire 18 is encouraged, and overheating in any of the wraps of the magnet wire 18 is inhibited when an electrically current is run through the magnet wire 18. The cover piece 20 particularly assists in inhibiting overheating in the first and last wraps of magnet wire 18, which are shown at 44 and 46 respectively in FIG. 2*a*, where there may be reduced wire tension holding the wraps 44 and 46 against the other wraps that make up the coil 17 of magnet wire 18.

In addition to inhibiting overheating of the magnet wire 18, the cover piece 20 provides another advantage. By fitting the cover piece 20 over the coil 17 of magnet wire 18 on the bobbin 16, the resulting assembly can be transported and manipulated with a reduced risk of the magnet wire 18 from becoming unwound from the bobbin 16. For example, referring to FIG. 4, when the ends 36 and 38 of the magnet wire 18 are being stripped of their insulation layer in preparation for subsequent connection to lead wires 41 and 42, the cover piece 20 inhibits the unwinding of the magnet wire 18 from the bobbin 16. By facilitating transport and manipulation of the bobbin 16 and magnet wire 18, the cover piece 20 facilitates manufacturing of the electromagnetic coil assembly 10 whether that manufacture is by automated or manual means.

In general, if a magnet wire were to contact an electrically conductive yoke of an electromagnetic coil assembly, the performance of the electromagnetic coil assembly would suffer. In the electromagnetic coil assembly 10, the cover piece 20 inhibits contact between the magnet wire 18 and the yoke 14. The cover piece 20 may be made from an electrically insulative material such as a non-reinforced or low-reinforced Nylon or PBT.

The cover piece 20 is generally C-shaped and is resilient to facilitate its mounting around the coil 17 of magnet wire 18. In this way, the cover piece 20 can be stretched open as needed to clear one of the flanges 24 or 26 and can then be relaxed to close around the coil 17. The cover piece 20 is configured to have a selected diameter in its rest position, which is less than the diameter of the coil 17, so that it is in a stretched state when in position around the coil 17. This permits the cover piece 20 to maintain a compressive force on the coil 17.

The process for mounting the self supporting cover piece 20 over the coil 17 may be quicker, less complex and less prone to error, relative to some processes wherein an adhesive tape is wrapped around a coil. Furthermore, the cover piece 20 can be mounted over the coil 17 by an automated process easily and reliably relative to some processes that wrap an adhesive tape over a coil.

Referring to FIG. 1, the electromagnetic coil assembly further includes first and second connectors 48 and 50, which are used to join the ends 36 and 38 of the magnet wire to the ends 39 and 40 of the lead wires 41 and 42.

Figure 4:
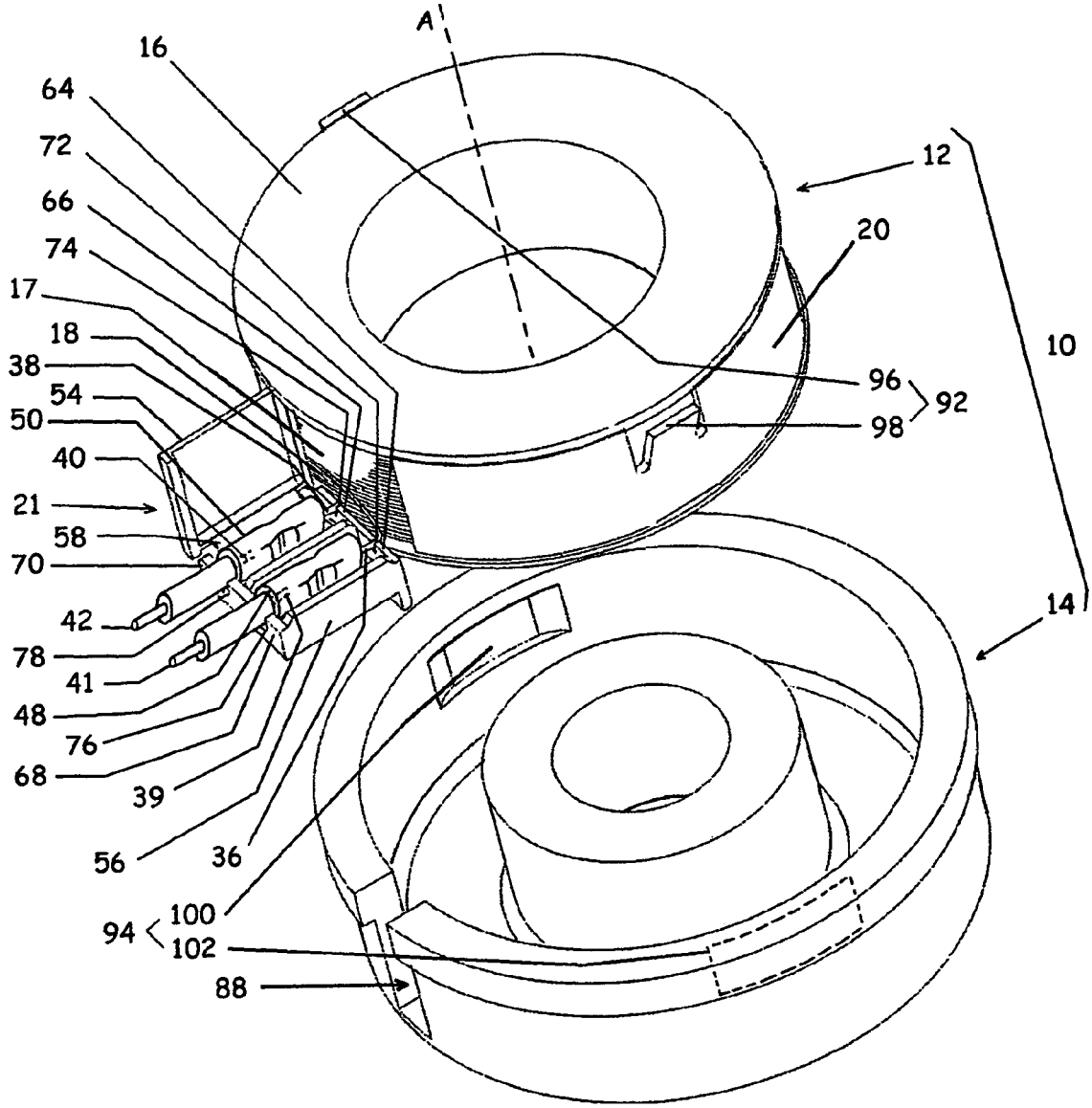
FIG. 4 is a perspective, partially exploded view of the electromagnetic coil assembly shown in FIG. 1, in an earlier stage of assembly than that shown in FIG. 1.

Referring to FIG. 4, the connector 48 has an aperture therethrough, one end of which receives the end 36 of the magnet wire 18, and the other end of which receives the end 39 of the lead wire 41. The wire ends 36 and 39 may be positioned in the connector 48 in parallel (wherein their ends lie parallel to one another) or in a butt-end configuration (wherein their ends are mutually abutted against each other). The connector 48 may be crimped subsequent to the insertion of the ends 36 and 40, to hold them in place in the connector 48, thereby providing an electrical connection between the first magnet wire end 36 and the lead wire end 39. Referring to FIG. 4, the connector 50 connects the second end 38 of the magnet wire 18 to the lead wire end 40 in a similar way to the electrical connection provided between the first magnet wire end 36 and the lead wire end 39 provided by the connector wire 48.

The connectors 48 and 50 may be made from a suitable material. For example, the connectors 48 and 50 may be made from an electrically conductive material such as copper or a copper plated material, aluminum.

Other retaining means may be used other then crimping to retain the wire ends 36 and 39 and 38 and 40 in the connectors 48 and 50. For example, a suitable electrically conductive adhesive may be used. As a further alternative, the retaining means may be a combination of crimping and adhesive.

Referring to FIG. 4, the connector housing 21 is provided for housing the connection between the magnet wire ends 36 and 38 and the lead wire ends 39 and 40. The connector housing 21 may be integrally connected to the cover piece 20. The connector housing 21 may have a clamshell configuration, whereby it includes a first connector housing portion 54 and a second connector housing portion 56, which is hingedly connected to the first connector housing portion 54 by a hinge 58. The hinge 58 may be a living hinge so that both the connector housing portions 54 and 56 and the cover piece 20 are all integrally connected. By configuring the connector housing 21 and the cover piece 20 to be integrally connected together and by selecting the suitable shape for these components, as shown in FIG. 3, they can be manufactured together simply, such as by injection molding using two mold plates.

The connector housing 21, when closed as shown in FIG. 1, defines a first channel 60 and a second channel 62 which receive the connectors 48 and 50 respectively.

Figure 3:
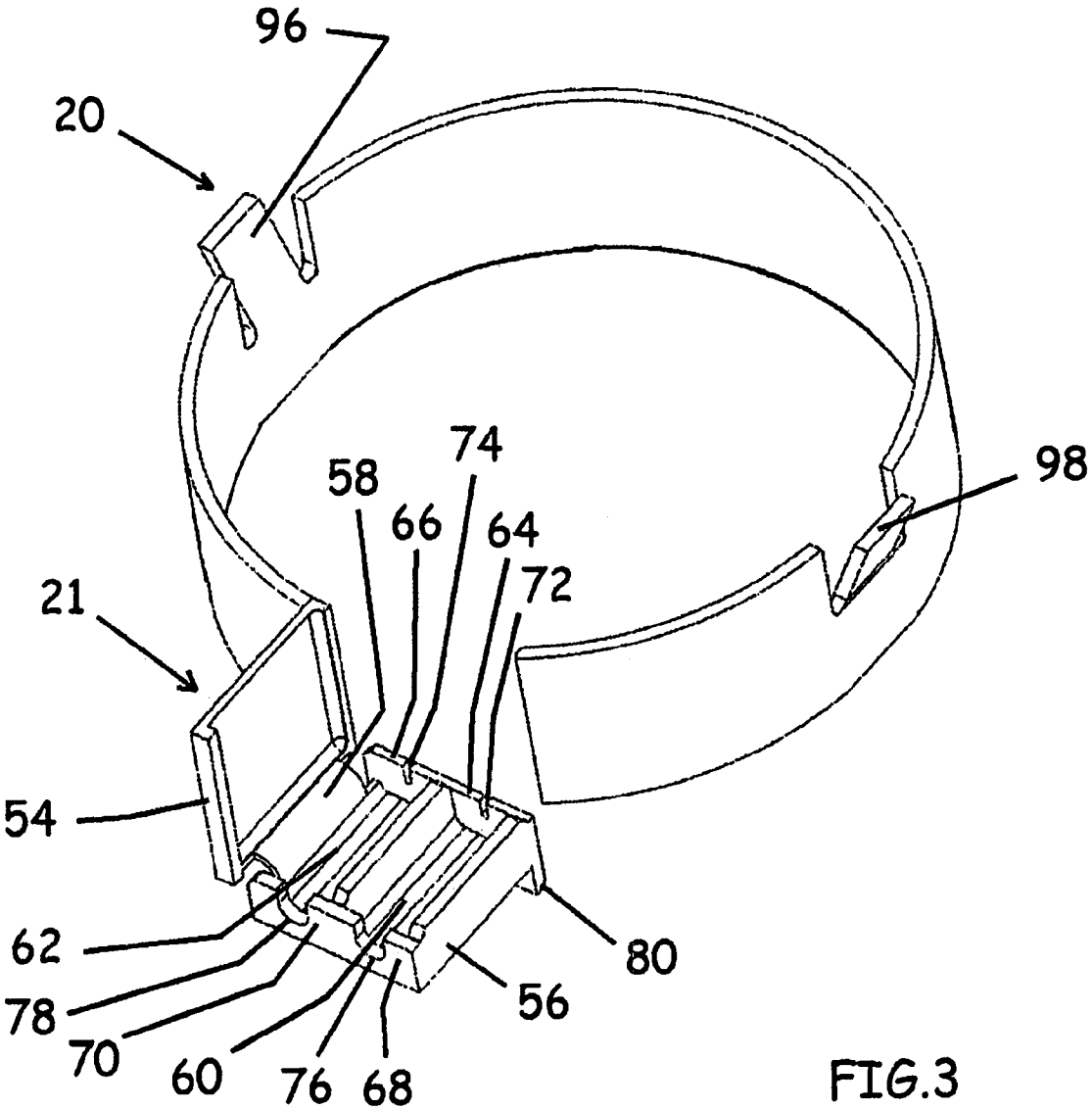
FIG. 3 is a perspective view of a cover piece shown in FIG. 1.

Referring to FIG. 3, the first and second channels 60 and 62 may be provided in part in each of the connector housing portions 54 and 56. For example, a generally U-shaped portion of each of the channels 60 and 62 may be provided in the second connector housing portion 56, and the first connector housing portion 54 may be used to cover each of the U-shaped portions to form the closed channels 60 and 62.

Referring to FIG. 4, the channels 60 and 62 have first end walls 64 and 66 respectively and second end walls 68 and 70 which act as barriers to prevent the withdrawal of the connectors 48 and 50 from the channels 60 and 62. The first end walls 64 and 66 have apertures 72 and 74 therethrough respectively to permit the pass-through the magnet wire ends 36 and 38 respectively. The apertures 72 and 74 are sized to receive the magnet wire 18, but are sufficiently small to prevent the pass-through of the connectors 48 and 50 respectively. Similarly, the second end walls 68 and 70 have apertures 76 and 78 respectively for the pass-through of the lead wire ends 39 and 40. The apertures 76 and 78 are sized to receive the lead wires 41 and 42 respectively, while being sufficiently small to prevent the pass-through of the connectors 48 and 50 respectively.

After the wire ends 36 and 39 and 38 and 40 are fixedly retained in the connectors 48 and 50, and after the connectors 48 and 50 are inserted into the channels 60 and 62, the first and second connector housing portions 54 and 56 are mated together as shown in FIG. 1 to capture the connectors 48 and 50 in the channels 60 and 62.

Referring to FIG. 1, when the second connector housing portion is folded upwards to mate with the first connector housing portion 54 the connector housing locking tab 80 can be positioned between the first and second flanges 24 and 26 of the bobbin 16. The second connector housing portion 56 may be biased towards its open position, as shown in FIG. 3, by any suitable means, eg. by means of the living hinge 58. The second connector housing portion 56 includes a connector housing locking tab 80 which can be positioned between the first and second flanges 24 and 26 of the bobbin 16 when the second connector housing portion 56 is in the closed position, as shown in FIG. 1. Engagement of the connector housing locking tab 80 with the first and second flanges 24 and 26 inhibits the second connector housing portion 56 from moving out of its closed position, shown in FIG. 1, towards its open position, shown in FIG. 4, under the influence of the living hinge 58. Providing locking tab 80 to keep the second connector housing portion 56 closed against the first connector housing portion 54 facilitates transport and manipulation of the subassembly 12 after the magnet wire 18 is connected to the lead wire ends 39 and 40.

After the connector housing 21 is closed, the subassembly 12 can then be inserted into the yoke 14. The yoke 14 is configured to receive and retain the subassembly 12. The yoke 14 is made from a ferromagnetic material, such as a high-permeability carbon steel or a nickel steel alloy and provides a magnetic circuit path for the electromagnet formed by the subassembly 12. The yoke 14 includes a yoke channel 82 that extends circumferentially about the axis A. The channel 82 is defined in part by a radially outer wall 84 and in part by a radially inner wall 86. An aperture 88 extends through the outer wall 84 and connects with the channel 82. The subassembly 12 may be slid axially into the channel 82 with the connector housing 21 being received in the aperture 88. The aperture 88 permits the pass-through of the connector housing 21 to the exterior of the yoke 14 when the subassembly 12 is positioned in the yoke channel 82. Additionally, the aperture 88 co-operates with the connector housing 21 to retain the cover piece 20 in a fixed circumferential position with respect to the yoke 14. The connector housing 21 may optionally include lead-in angles 90 on its leading edge corners to facilitate sliding entry of the connector housing 21 into the aperture 88 (see FIG. 1).

A subassembly connector 92 cooperates with a yoke connector 94 to connect the subassembly 12 to the yoke 14. The subassembly connector 92 may be positioned on the cover piece 16, as shown in FIG. 4. The subassembly connector 92 may include a pair of resilient tabs 96 and 98 that extend outwards beyond the outer edge of the first and second flanges 24 and 26 on the bobbin 16. The tabs 96 and 98 engage recesses 100 and 102, which make up the yoke connector 94, and which are positioned in the outer wall 84 of the yoke 14, to retain the subassembly 12 in the yoke 14. The tabs 96 and 98 are preferably spaced apart about the circumference of the cover piece 20. For example, they may be 180 degrees apart about the circumference of the cover piece 20, ie. on opposite sides of the cover piece 20. Alternatively, they may be spaced by some other amount about the circumference of the cover piece 20. The tabs 96 and 98 are shown in FIG. 4 as being on opposite sides of the cover piece 20 and at 90 degrees from the connector housing 21. Alternatively however, they may be at some other angle relative to the connector housing 21. For example, the tab 96 may be immediately adjacent the connector housing 21, and the tab 98 could be positioned at some other circumferential position, eg. 180 degrees from the tab 96.

The recesses 100 and 102 are positioned to receive the tabs 96 and 98 when the subassembly 12 is slid into the yoke 14 with the connector housing 21 in alignment with the aperture 88. The recesses 100 and 102 are made sufficiently deep into the outer wall 84 of the yoke 14 so that the tabs 96 and 98 achieve a suitable amount of engagement with the recesses 100 and 102 to retain the subassembly 12 in the yoke 14 during transport and manipulation of the electromagnetic coil assembly 10. However, it is preferable that the recesses 100 and 102 do not extend completely through the outer wall 84 of the yoke 14. By not extending the recesses 100 and 102 completely through the outer wall 84, they do not form apertures through the outer wall 84, which improves the magnetic flux pattern around the outer wall 84, relative to an embodiment where holes through the outer wall 84 are created for the recesses 100 and 102.

It will be appreciated that, in the embodiment shown in FIGS. 1-5, the bobbin 16 does not have any locating features thereon that require alignment with corresponding features on the yoke 14. By providing the locating features only on the cover piece 20 and not on the bobbin 16, the bobbin 16 and cover piece 20 can be rotated relative to each other as necessary to position the connector housing to receive the connectors 48 and 50, regardless of the exact length of the magnet wire 18. Thus, the manufacture of the subassembly 12 is simplified and does not necessarily result in a problem part if the magnet wire 18 is not the exact needed length as would be the case if both the bobbin 16 and the cover piece 20 both needed to be separated aligned circumferentially with the yoke 14. Additionally, by providing the locating features only on the cover piece 20, only one component (ie. the cover piece 20 in the embodiment shown in FIGS. 1-5), needs to be aligned in a particular circumferential position when the subassembly 12 is slid into the yoke 14, thus reducing a step of aligning a second component (ie. the bobbin 16 in the embodiment shown in FIGS. 1-5) with the yoke 14 during assembly of the electromagnet assembly 10.

Figure 5:
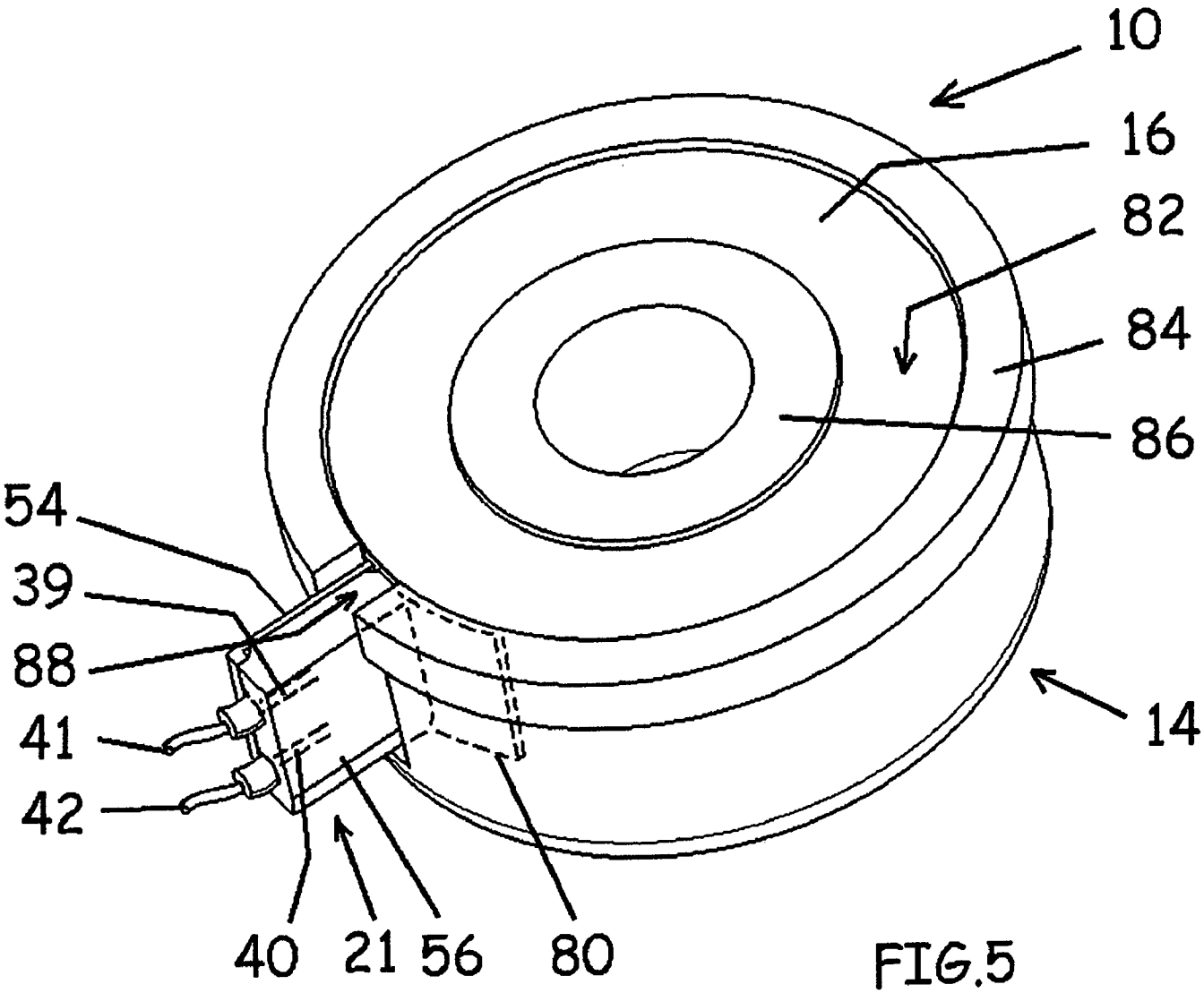
FIG. 5 is a perspective view of the electromagnetic coil assembly shown in FIG. 1, fully assembled.

When the subassembly 12 is positioned in the yoke 14, as shown in FIG. 5, the walls of the aperture 88 prevent the second connector housing portion 56 from opening away from the first connector housing portion 54. Additionally, the outer wall 84 and the floor of the channel 82 cooperate to prevent the connector housing locking tab 80 from moving in the radial direction thereby preventing the second connector housing portion 56 from separating from the first connector housing portion 54.

In the event that the lead wires 41 and 42 are pulled during use, the connectors 48 and 50 will exert a force in the radial direction on the first and second connector housing portions 54 and 56. The first connector housing portion 54 is connected directly to the cover piece 20, which is prevented from movement in the radial direction by the presence of the outer wall 84. Thus, the first connector housing portion 54 is prevented from movement in the radial direction. The second connector housing portion 56 has the connector housing locking tab 80 connected to it. The outer wall 84 of the yoke 14 limits movement of the connector housing locking tab 80 in the radial direction and thus prevents the second connector housing portion 56 from movement in the radial direction.

The electromagnetic coil assembly 10 may be used in an axial electromagnetic clutch assembly with radial lead wires. Alternatively, the electromagnetic coil assembly 10 may be used with other configurations of bobbin-mounted coil assembly.

Figure 6:
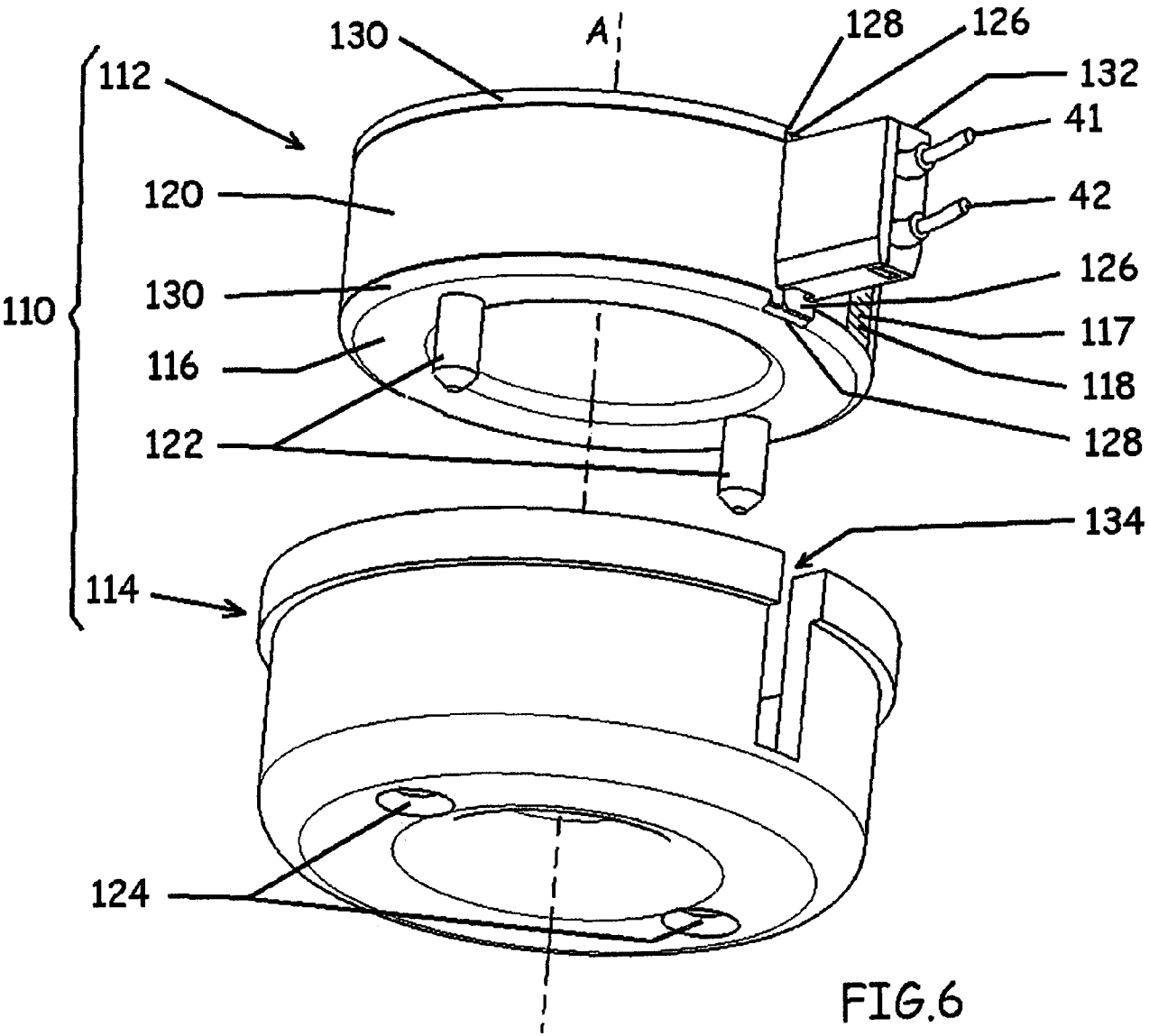
FIG. 6 is a perspective, partially exploded view of an electromagnetic coil assembly in accordance with another embodiment of the present invention.

Reference is made to FIG. 6, which shows an electromagnetic coil assembly 110 in accordance with another embodiment of the invention. The electromagnetic coil assembly 110 includes a subassembly 112 and a yoke 114. The subassembly 112 includes a bobbin 116, a coil 117 of magnet wire 118 and a cover piece 120. The bobbin 116 may be similar to the bobbin 16 (FIG. 1), except that the bobbin 116 includes a bobbin locating feature which cooperates with a corresponding feature on the yoke 114 to fix the bobbin 116 circumferentially with respect to the yoke 114. The bobbin locating feature may be, for example, two mounting pins 122 which pass through apertures, shown at 124 on the yoke 114 during axial sliding movement of the subassembly 112 into the yoke 114. The apertures 124 would thus make up an exemplary corresponding feature on the yoke 114.

When the subassembly 112 is positioned in the yoke 114, the pins 122 extend through the apertures 124 to the exterior of the yoke 114. The tips of the pins 122 which protrude from the apertures 124 may then be heated and formed into mushroom heads to prevent them from being pulled back through the apertures 124, thus retaining the subassembly 112 in place in the yoke 114.

The cover piece 120 may be similar to the cover piece 20 (FIG. 1), except that the cover piece 120 includes locating tabs 126, which engage with notches, shown at 128, in one or both of the bobbin flanges, shown at 130. The locating tabs 126 cooperate with the notches 128 to position the cover piece 120, and more particularly the connector housing, shown at 132, in a specific circumferential position relative to the bobbin 116. The locating tabs 126 may be positioned anywhere on the cover piece 120, such as, for example, on the connector housing 132. By positioning the connector housing 132 at a selected circumferential position relative to the mounting pins 122, the connector housing 132 will align with and be received in the connector housing-receiving aperture, shown at 134, in the yoke 114 when the mounting pins 122 on the bobbin 116 are aligned with the mounting pin apertures 124 in the yoke 114.

By locking the cover piece 120 into the notches 128 on the bobbin 116, prior to sliding the subassembly 112 into the yoke 114, the sliding step is facilitated, since the connector housing 132 and pins 122 are all in the required positions relative to each other to be received in the apertures 134 and 124 in the yoke 114.

It will be appreciated that the shape of the subassemblies 12 (FIG. 1) or 112 (FIG. 6) and the yokes 14 (FIG. 1) or 114 (FIG. 6) need not be round. For example, they may have some other shape such as a square, depending on the intended application.

It has been shown for the first wrap and the last wrap to come around to the ends from opposite sides of the bobbin. For example, in FIG. 2*a*, the first wrap 44 extends around on the right side of the bobbin 16, and the last wrap extends around on the left side of the bobbin 16. It is alternatively possible however, for the embodiments of the present invention shown in FIGS. 1-5 and in FIG. 6 to have one of the wraps (eg. the first wrap 44) extend around the bobbin overshooting the end of the other wrap (eg. the end 40 of the last wrap 46), and then double back on itself, so that both the first and last wrap run in the same direction briefly.

It has been described that the connector housing includes two channels 60 and 62, which are each sized for receiving one connector 48 or 50. It is alternatively possible for the connector housing to include a single, large channel for holding both connectors 48 and 50. In this alternative, the single large channel would include a first end wall preferably with two apertures for the pass-through of the magnet wire ends 36 and 38 and a second end wall preferably with two apertures for the pass-through of the lead wire ends 39 and 40.

It has been described that the connector housing is integrally connected to the cover piece. While this is preferable, it is alternatively possible for the connector housing to be a separate component that is connected to the cover piece.

It is possible that a single entity may provide the entire electromagnetic coil assembly 10 or 110 including the bobbin 14 or 114, the coil 17 or 117 of magnet wire 18 or 118, the cover piece 20 or 120, the connector housing 21 or 132 and the connectors 48 and 50. The assembly 10 or 110 may be provided on its own for later incorporation into a machine such as an axial electromagnet-actuated clutch for a vehicle. Alternatively, the assembly 10 or 110 may be provided directly incorporated into a machine.

It is alternatively possible however, that certain groups of components may be provided by different supplier companies. For example, the bobbin and cover piece with the integral connector housing may be provided together as a housing assembly by a supplier to a customer. A coil of magnet wire can then be added to the housing assembly. After the coil is added to the housing assembly, the magnet wire can be connected to lead wires using connectors having a suitable size to fit within the connector housing, and the resulting assembly can be incorporated into a machine. As another alternative, the supplier could supply the housing assembly further including the connectors that fit within the connector housing. As yet another alternative, the supplier could supply the subassembly 12, 112, with or without the connectors 48 and 50, thereby omitting supplying the yoke 14 or 114. The yoke 14 or 114 could be provided by another entity, such as by the customer. As yet another alternative, in an embodiment wherein the connector housing is separate from the cover piece and is connected thereto, the supplier could supply an assembly comprising the bobbin, the coil of magnet wire and the cover piece. In addition, the supplier could optionally supply the connector housing and could optionally connect the connector housing to the cover piece.

While the above description described some embodiments of the present invention, it will be appreciated that the present invention is susceptible to modification and change without departing from the fair meaning of the accompanying claims.

The invention claimed is:

1. An electromagnetic coil assembly comprising:

a bobbin, including a hub, a first flange and a second flange, wherein the hub has a longitudinal axis, wherein the first and second flanges are spaced axially from each other, wherein the hub and the flanges together define a circumferential bobbin channel, wherein the bobbin is made from a material that is an electrical insulator; a coil of magnet wire around the hub in the circumferential bobbin channel, wherein the magnet wire has first and second ends;

first and second connectors, wherein each connector retains and electrically connects one end of the magnet wire and one end of a lead wire; a cover piece, wherein the cover piece is self-supporting and extends circumferentially around the coil of magnet wire; and a connector housing, wherein the connector housing is connected to the cover piece, wherein the connector housing has at least one connector housing channel, wherein the first and second connectors are held in the at least one connector housing channel, wherein the at least one connector housing channel has first and second end walls which prevent withdrawal of the first and second connectors from the connector housing, wherein the connector housing includes a first connector housing portion and a second connector housing portion hingedly connected to the first connector housing portion, and wherein the first and second connector housing portions are matable together to enclose the connectors.

2. An electromagnetic coil assembly as claimed in claim 1, wherein the bobbin, coil of magnet wire, first and second connectors, cover piece and connector housing make up a subassembly, and wherein the electromagnetic coil assembly further comprises a yoke, wherein the yoke is made from a ferromagnetic material, wherein the yoke defines an open, circumferential yoke channel, wherein the yoke channel is sized to receive the subassembly by axial sliding movement of the subassembly into the yoke channel, wherein the first connector housing portion is connected to the cover piece, and wherein the second connector housing portion includes a connector housing locking tab that is positioned radially in from the radially outer wall of the yoke and that engages the radially outer wall of the yoke to limit movement of the second connector housing portion radially outwardly.

3. An electromagnetic coil assembly, comprising:

a bobbin, including a hub, a first flange and a second flange, wherein the hub has a longitudinal axis, wherein the first and second flanges are spaced axially from each other, wherein the hub and the flanges together define a circumferential bobbin channel, wherein the bobbin is made from a material that is an electrical insulator;

a coil of magnet wire around the hub in the circumferential bobbin channel, wherein the magnet wire has first and second ends; first and second connectors, wherein each connector retains and electrically connects one end of the magnet wire and one end of a lead wire; a cover piece, wherein the cover piece is self-supporting and extends circumferentially around the coil of magnet wire; and a connector housing, wherein the connector housing is connected to the cover piece, wherein the connector housing holds the first and second connectors, wherein the bobbin, coil of magnet wire, first and second connectors, cover piece and connector housing make up a subassembly; and a yoke, wherein the yoke is made from a ferromagnetic material, wherein the yoke defines an open, circumferential yoke channel, wherein the yoke channel is sized to receive the subassembly by axial sliding movement of the subassembly into the yoke channel, wherein the bobbin is rotatable with respect to the cover piece and the yoke when the subassembly is positioned in the yoke channel, wherein at least one locating feature is connected to the cover piece, wherein the at least one locating feature cooperates with the yoke to fix the position of the cover piece and connector housing circumferentially in the yoke.

4. An electromagnetic coil assembly as claimed in claim 3, wherein the channel has a radially outer wall, wherein the radially outer wall has an aperture therethrough, wherein the aperture is sized to receive the connector housing during axial sliding movement of the subassembly into the yoke channel, and wherein the aperture and the connector housing cooperate to fix the cover piece and connector housing circumferentially in the yoke.

5. An electromagnetic coil assembly as claimed in claim 4, wherein the cover piece includes a cover piece connector, and wherein the yoke includes a yoke connector and wherein the cover piece connector engages the yoke connector to retain the subassembly in the yoke.

6. An electromagnetic coil assembly as claimed in claim 5, wherein the cover piece connector includes at least one cover piece tab, and wherein the yoke connector includes at least one recess, wherein the at least one tab engages the recess to retain the cover piece, bobbin and magnet wire in the yoke.

7. An electromagnetic coil assembly as claimed in claim 6, wherein the recess extends only partially through the outer wall of the yoke.

* * * * *